US006496082B1

(12) United States Patent
DiPiazza

(10) Patent No.: US 6,496,082 B1
(45) Date of Patent: Dec. 17, 2002

(54) MATCHED BROADBAND SWITCH MATRIX WITH ACTIVE DIODE ISOLATION

(75) Inventor: Gerald Charles DiPiazza, Edenton, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/962,820

(22) Filed: Sep. 25, 2001

(51) Int. Cl.[7] ..... H01P 1/15

(52) U.S. Cl. ..... 333/101; 333/103; 333/101; 333/105; 333/116; 333/81 R; 333/262; 385/16

(58) Field of Search ..... 333/101, 103, 333/104, 105, 116, 262, 81 R; 385/16

(56) References Cited

U.S. PATENT DOCUMENTS 3,808,566 A * 4/1974 Thompson et al. ..... 333/101
4,044,307 A * 8/1977 Borysiewicz et al. ..... 333/18
4,316,159 A * 2/1982 Ho ..... 333/104
4,472,691 A * 9/1984 Kumar et al. ..... 333/103
4,739,247 A * 4/1988 Cisco et al. ..... 333/101
5,150,083 A * 9/1992 Chen et al. ..... 333/103
5,444,801 A * 8/1995 Laughlin ..... 385/16
5,446,424 A * 8/1995 Pierro ..... 333/104
5,553,175 A * 9/1996 Laughlin ..... 372/10
5,555,558 A * 9/1996 Laughlin ..... 385/16
5,566,260 A * 10/1996 Laughlin ..... 385/16
5,647,033 A * 7/1997 Laughlin ..... 385/16
5,875,271 A * 2/1999 Laughlin ..... 385/16

* cited by examiner

*Primary Examiner*—Michael Tokar
*Assistant Examiner*—Lam T. Mai

(57) ABSTRACT

A method and apparatus are disclosed for isolating a selected switching connection, within a switch matrix. The switching connection is isolated by forming two shunt stubs, or equivalent lumped circuits, each having an electrical length such that the input impedance of the shunt stub is high. The shunt stubs are formed on the appropriate input and output signal lines of the switch matrix on the side distant from the side of the input and output lines preferred for the propagation of the signal. The switch matrix may be constructed within and on a glass substrate.

23 Claims, 4 Drawing Sheets

MATCHED BROADBAND SWITCH MATRIX WITH ACTIVE DIODE ISOLATION

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

Switching high speed optical signals can require a switching matrix that is capable of switching broad bandwidth signals that can have both a very high upper cutoff frequency, i.e., 40 GHz and higher, and a very low cutoff frequency, i.e., 100 KHz or lower. In addition, the switch matrix must be able to maintain the signal fidelity over the entire frequency range. To maintain the necessary fidelity, a switch must be properly matched to minimize the mismatch reflections that will occur over the frequency range, and particularly at the higher frequencies.

Typically, isolation switches have been placed in series with the signal switching devices. The isolation switches have a low "on" resistance and a high "off" resistance. The isolation switches closest to the signal switching device, on the side away from the signal propagation path are switched off to isolate the signal switching device. However, the isolation switches typically have high parasitic reactances that, although ignored at lower frequencies, adversely impact the performance of the switch matrix at high frequencies and lead to generation of amplitude, phase, and delay distortions that can cause serious deterioration in bit error rates for high speed data channels.

Therefore, it would be desirable to provide a switch matrix that provides for isolating and matching of the input signals across a very broad bandwidth.

BRIEF SUMMARY OF THE INVENTION

A method and apparatus are disclosed for isolating a selected switching connection, within a switch matrix. The switching connection is isolated by forming two shunt stubs, or lumped circuit equivalents, each having an electrical length such that the input impedance of the shunt stub is high. The shunt stubs are formed on the appropriate input and output signal lines of the switch matrix on the opposite side of the input and output lines from the preferred direction for the propagation of the switched signal. It will be shown in subsequent sections of this disclosure that the use of the shunt stub architecture facilitates simplified biasing of the active isolation devices, provides for broadband isolation of the selected signal transmission path, and, together with appropriate spacing of the matrix transmission lines, minimizes the effects of the parasitic reactances of the active signal and isolation switching devices.

In particular, in one embodiment, a switch matrix is disclosed having a plurality of input and output signal lines. Each of the input signal lines has a signal input end and a non-input signal end and each of the output signal lines has a signal output end and a non-output signal end. The switching matrix switches a broadband signal of interest (having a center frequency) between a an input signal line and a signal output line using one of a plurality of signal switches. Each one of the plurality of signal switches is coupled to a single input signal line and a single output signal line. Accordingly, when a selected signal switch is activated, the signal of interest is coupled between the selected input signal line and the selected output signal line.

The switch matrix further includes a plurality of first isolation switches, each of which is associated with a single signal switch. Each of the plurality of first isolation switches are coupled to one of the plurality of output signal lines associated with the single signal switch. The isolation switch is further coupled to ground forming a tuning stub when it is activated. The length of the tuning stub is determined by the spaced apart distance each isolation switch is disposed from the single signal switch. Thus, when the first isolation switch is activated, the portion of the output line between the associated signal switch and the isolation switch forms the tuning stub of the first predetermined length. Preferably, the first predetermined length is equal to a predetermined electrical length of transmission line that is one quarter wavelength and the center frequency of the signal of interest.

The switching matrix also includes a plurality of second isolation switches, each of which is associated with a single signal switch. Each of the second plurality of isolation switches is coupled to one of the plurality of input signal lines associated with the single signal switch. Each of the plurality of isolation switches is further coupled to ground forming a tuning stub. The length of the tuning stub is determined by the spaced apart distance each isolation switch is disposed from the associated signal switch. Thus, when a second isolation switch is activated, the portion of the input line between the associated signal switch and the isolation switch forms the tuning stub of the second predetermined length. Preferably, the second predetermined length is equal to a predetermined electrical length of transmission line that is one quarter wavelength and the center frequency of the signal of interest.

In one aspect of the present invention, the plurality of signal switches and the first and second isolation switches are a plurality of semiconductor switching elements, and are selected from the group of switching diodes, thryristors, and transistors. In particular, the plurality of switching diodes are a plurality of PIN diodes, the plurality of transistors are a plurality of bipolar junction transistors, the plurality of transistors are a plurality of field effect transistors.

In another aspect of the present invention, the first and second predetermined electrical length is an odd integer multiple of the quarter-wavelength of the signal of interest. In particular, the first and second predetermined electrical distances are one-quarter wavelength of the signal of interest.

In another embodiment, the first and second stub are provided for by a plurality of lumped circuit elements that provide the same impedance transforming function as the stub. In particular, the lumped circuit is a pi-section that includes an inductor coupled to a capacitor at each end, and where each of the capacitors are further coupled to ground. Alternatively, a pi-section can be formed that includes a capacitor coupled to an inductor at each end, and where each of the inductors are further coupled to ground. The use of lumped elements facilitates size matrix reduction relative to the distributed transmission line counterpart.

Other forms, features and aspects of the above-described methods and system are described in the detailed description that follows.

BRIEF DESCRIPTION OF THE SEVERAL VIEWS OF THE DRAWING

The invention will be more fully understood by reference to the following Detailed Description of the Invention in conjunction with the drawings of which.

DETAILED DESCRIPTION OF THE INVENTION

Figure 1:
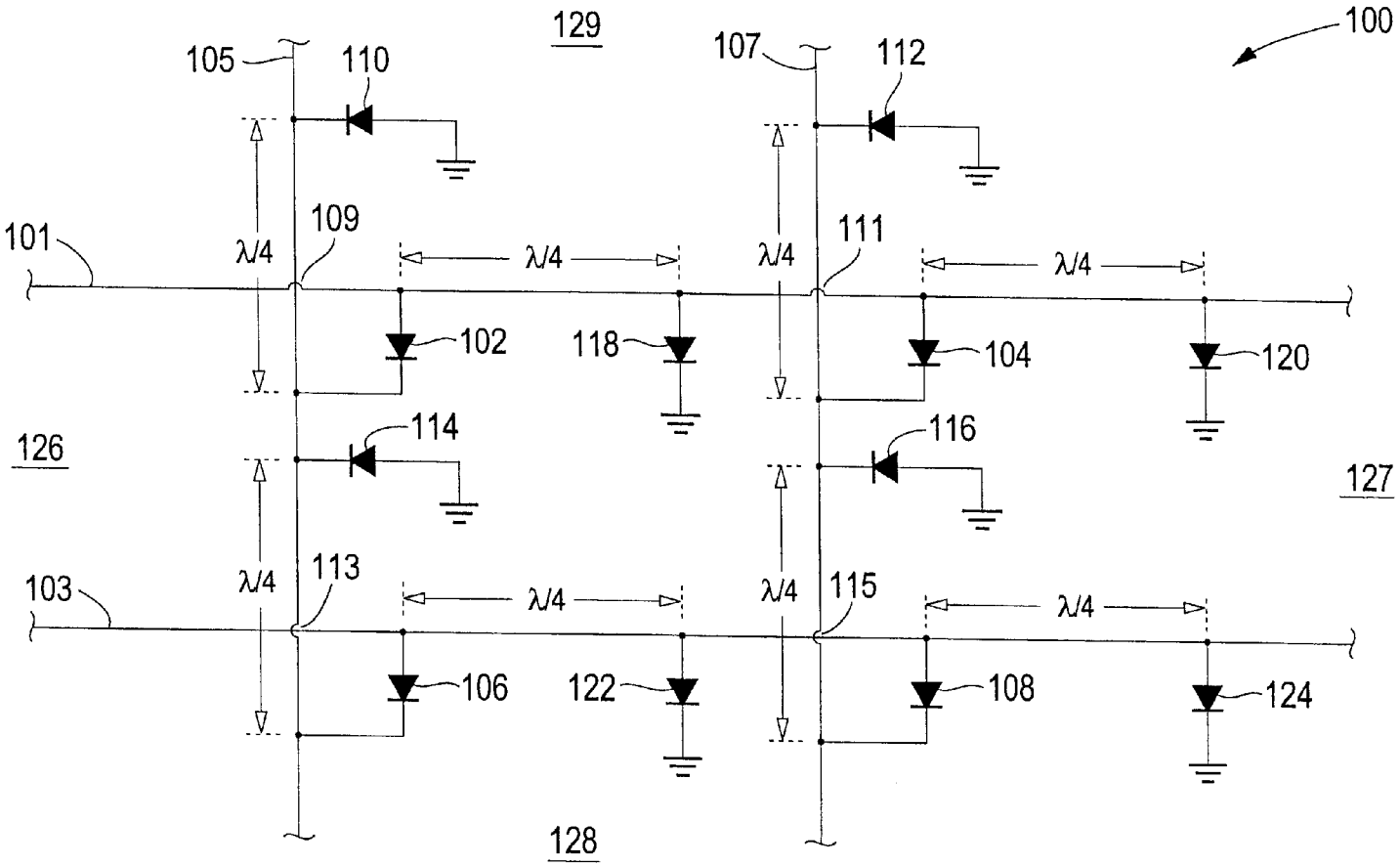
FIG. 1 is a schematic diagram of one embodiment of a switch matrix including the presently described stub tuner.

FIG. 1 illustrates one embodiment of a switching matrix 100 incorporating the presently described techniques for isolating a switching junction within the switch matrix. The switching matrix 100 is designed to switch signals having a center frequency, $f_0$, and a bandwidth, B. In particular switch matrix 100 includes input signal lines 101 and 103 and output signal lines 105 and 107. The input signal lines 101 and 103 include an input signal end 126 and a non-input signal end 127. The output signal lines 105 and 107 include an output signal end 128 and a non-output signal end 129. The cross points—109, 111, 113, and 115—of the input lines 101 and 103 and the output lines 105 and 107 are not electrically connected to one another. Rather, switching diodes 102, 104, 106 and 108, when selected and activated, are used to electrically couple a particular input line to a particular output line. In the illustrative embodiment, switching diode 102 interconnects the cross point 109, switching diode 104 interconnects the cross point 111, switching diode 106 interconnects the cross point 113, switching diode 108 interconnects the cross point 115.

In the embodiment depicted in FIG. 1, switching diode 102 is associated with shunt diodes 110 and 118, switching diode 106 is associated with shunt diodes 114 and 122, switching diode 104 is associated with isolation diodes 112 and 120, and switching diode 108 is associated with shunt diodes 116 and 124.

The switching diodes 102, 104, 106, and 108 can be selected and activated using any methods known in the art. For example, an external bias network (not shown) may be used to select a particular diode, or the input lines 101 and 103 and output lines 105 and 107 may be appropriately biased using positive and negative voltages in order to forward bias a selected switching diode. Although switching diodes are shown they are for illustrative purposes only and any form of electronic switch may be used that satisfies the overall system requirements for speed, bandwidth, parasitics, and the fidelity of the output signal. For example, other semiconductor switches may be used such as PIN diodes, thryristors, field effect transistors, and bipolar junction transistors.

As shown in FIG. 1, each switching diode has two shunt diodes associated therewith. Each shunt diode is coupled at one end to either the input or output line to which the corresponding switching diode is coupled. Each shunt diode is further coupled at the opposite end directly to either ground or coupled to ground via a feed through capacitor (not shown) wherein an external bias network is coupled to the other electrode to select the diode. Each shunt diode, when appropriately selected and activated, will shunt the corresponding input line or output line to ground forming a stub. The point at which each shunt diode is coupled to the corresponding input line or output line is spaced apart from the corresponding switching diode by a predetermined distance. The predetermined distance, which is the physical length of the stub, also determines the electrical length of the stub. The electrical length of the stub is the length of the stub expressed as a multiple or submultiple of the wavelength of the electromagnetic signal of interest that propagates within the medium. In particular, the predetermined distance is selected such that the point at which the shunt diode is coupled to the input line or output line has an electrical length equal to an odd integer number quarter-wave lengths at the center frequency. In a preferred embodiment, the connection between each shunt diode and the corresponding input or output line has an electrical length of one quarter-wave length at the center frequency.

As is known, a stub acts as a impedance transformer, wherein the input impedance is a function of the load impedance, the impedance of the shorted stub, and the length of the shorted stub in terms of the center frequency. As is known, for a terminated transmission line the generalized impedance is given by:

$$Z_1 = Z_O * \frac{Z_L + j_O \tan(\beta l)}{Z_O + jZ_L \tan(\beta l)}$$

where $Z_L$ is the load impedance, $Z_O$ is the impedance of the transmission line and β1 is the wave number. For a quarter wave section of transmission line, β1 equals π/2. Accordingly, a quarter-wavelength stub reflects the load impedance to the input as:

$$Z_1 = Z_2 Z_L + \frac{jZ_2 \tan\left(\frac{\pi}{2}\right)}{Z_2 + jZ_L \tan\left(\frac{\pi}{2}\right)} = \frac{Z_2^2}{Z_L} \qquad \text{Eq. 1}$$

where $Z_L$ is the load impedance, $Z_2$ is the characteristic impedance of the stub, If $Z_L$ is zero, i.e., the end of the quarter wavelength stub is a short circuit, then the impedance $Z_1$ is infinite. In practice, the small forward resistance of the shunt diode limits the impedance $Z_1$ to a large, but not infinite, value. Similarly, the reflection coefficient of a quarter wavelength shorted stub is nearly 1, such that any signal incident on the quarter wavelength stub will be nearly entirely reflected therefrom. In addition, by using a shunt diode having a small forward resistance the insertion loss caused by the shunt diode may be minimized.

One advantage of the use of the quarter wavelength shorted stub is the relatively broadband bandwidth of the section in terms of the . In particular, it can be shown that the bandwidth, B, of a quarter wavelength shorted stub is given by:

$$B = \frac{8 * f_0}{\pi} * \frac{Z_{0S}}{Z_0} \qquad \text{Eq. 2}$$

where B is the bandwidth, $Z_0$ is the characteristic impedance of the transmission line, $Z_{0S}$ is the characteristic impedance of the stub, and $f_0$ is the center frequency. In particular, it can be seen from Eq. 2 that the value for $Z_{0S}$ should be greater than or equal to the value of $Z_0$ to avoid the reduction of the bandwidth. When $Z_{0S}$ is equal to $Z_0$ the bandwidth of the quarter wavelength stub is approximately 2.55 times the center frequency.

In the embodiment depicted in FIG. 1, the shunt diodes are selected as having a small forward bias resistance and (low) high frequency bias parasitic reactances at the center frequency. The shunt diodes, which can be any suitable electronic switching device such as PIN diodes, thyristors, FETs, and BJTs, can be activated using preselected voltages on the input lines and output lines such that only one shunt diode is active on each of the input lines and each of the output lines at any given time. It should be noted that in the embodiment depicted in FIG. 1, the selected output line must be selected using a voltage that is at least one shunt-diode voltage-drop lower than ground. Similarly, the selected input line must be selected using a voltage that is at least one shunt-diode voltage-drop higher than ground. Of course, other voltages may be selected depending upon the system requirements provided that the voltages on the input lines and output lines differ in voltage by at least one diode voltage drop. Thus, the particular switching node within the switching matrix will be isolated by the high-impedance/high reflectivity provided by the one-quarter-wavelength shorted stub located on the non-input side 127 and the non-output side 129 of the respective input and output line. Accordingly, a signal propagating on a particular input line that is switched to a selected output line by the corresponding activated switching diode is isolated by the quarter wavelength stubs formed by the activated shunt diodes. Thus, matching the switch and reducing reflections and losses.

Figure 2:
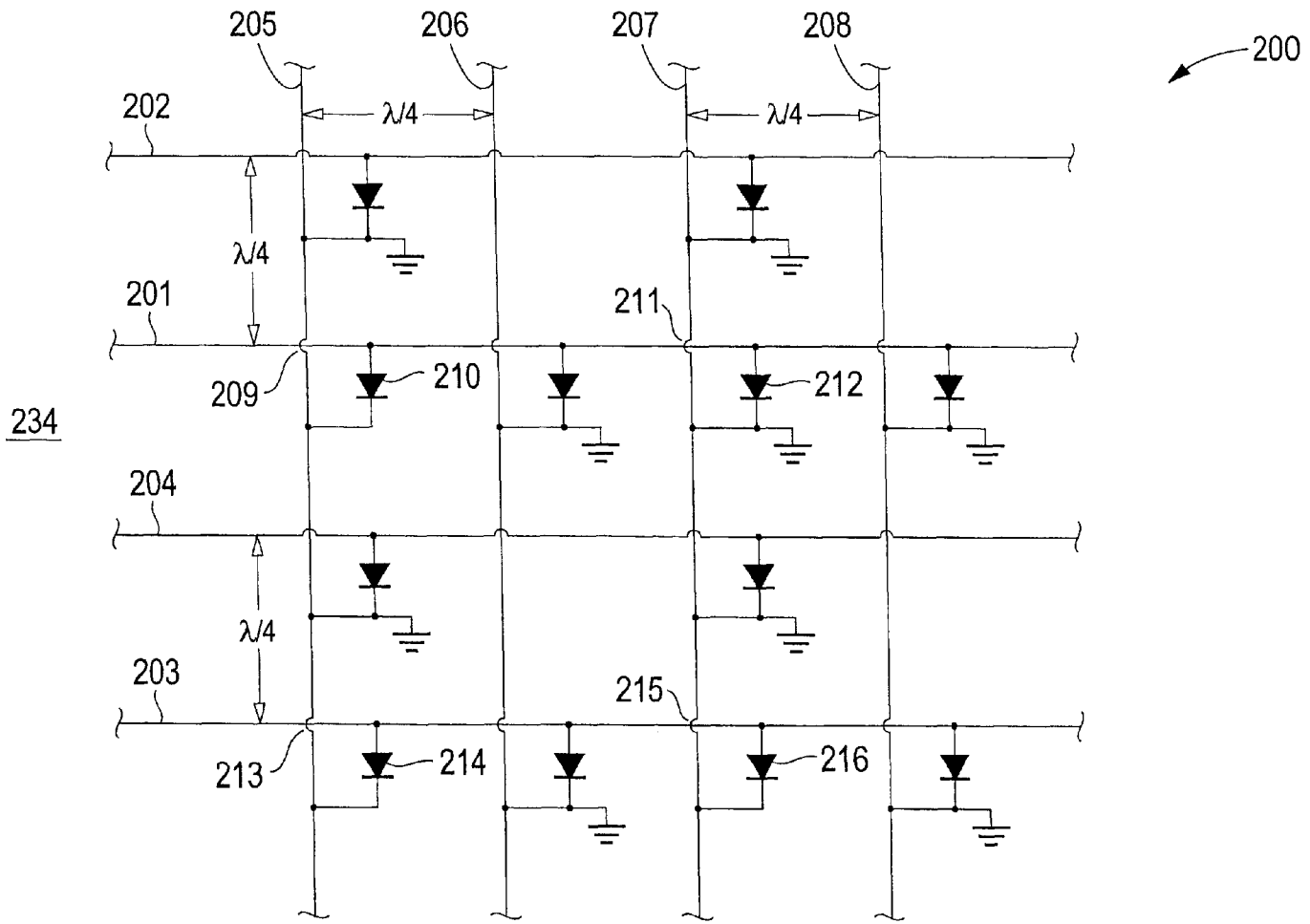
FIG. 2 is a schematic diagram of another embodiment of a switch matrix including the present described stub tuner.

FIG. 2 depicts another embodiment of a switch matrix 200 in which a separate shunt diode selection matrix is used. In this embodiment, a switch matrix 200 includes signal input lines 201 and 203, signal output lines 205 and 207, first shunt diode selection lines 202 and 204, and second shunt diode selection lines 206 and 208. The first shunt diode selection lines 202 and 204 are spaced apart an odd integer number of multiples of a quarter-wavelength from the corresponding signal input lines 201 and 203 respectively. Similarly, the second shunt diode selection lines 206 and 808 are spaced apart an odd integer number of multiples of a quarter-wavelength from the corresponding signal output lines 205 and 207 respectively. As described above, the cross points—209, 211, 213, and 215—are not electrically connected to one another. Rather, switching diodes 210, 212, 214 and 216, when selected and activated, are used to electrically interconnect the corresponding input signal line to a corresponding output signal line. In the illustrative embodiment, switching diode 210 interconnects the cross point 209, switching diode 212 interconnects the cross point 211, switching diode 214 interconnects the cross point 213, switching diode 216 interconnects the cross point 215. In this embodiment, the first shunt diode selection lines 202 and 204 are selected by a voltage that is at least one shunt-diode voltage drop greater than the selection voltage used to select a corresponding signal output line 405 and 407. Similarly, the second shunt diode selection lines 206 and 208 are selected by a voltage that is at least one shunt-diode voltage drop less than the selection voltage used to select a corresponding signal output line 405 and 407.

As discussed above, each of the first shunt diode selection lines 202 and 204 are spaced apart from the corresponding signal input lines 201 and 203 by an electrical length equal to an odd integer number of quarter wavelengths at the center frequency. In the embodiment depicted in FIG. 2, the electrical length is preferably one quarter wavelength at the center frequency of the signal of interest. In this way, when selected and activated, a selected shunt diode couples the selected output signal line to ground a quarter wavelength away from the selected signal input line, forming a shorted quarter wavelength stub, which as described above, has an ideal impedance of infinity and a reflection coefficient of one.

Figure 3:
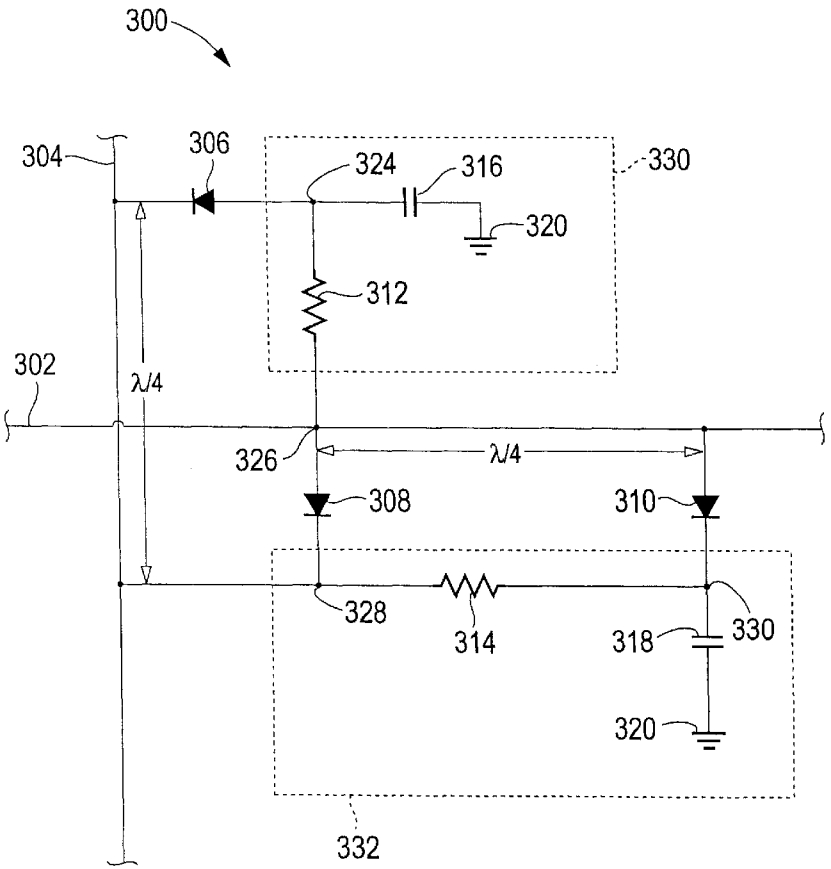
FIG. 3 is a schematic diagram of a biasing network to bias the isolation circuit included in the switch matrix of FIG. 1 and FIG. 2.

FIG. 3 depicts one embodiment of a bias network suitable for providing the necessary bias voltages to the various switches. In particular FIG. 3 depicts a resistor-capacitor network that provides the necessary biasing for the shunt and switching diodes. The resistor-capacitor network 300 includes a signal input line 302 and a signal output line 304. As above, the signal input line 302 and the signal output line 304 are not electrically coupled together. Switching diode 308, when activated, provides a low insertion loss connection therebetween. The switching diode has associated therewith two shunt diodes, 306 and 310. Each of the shunt diodes 306 and 310 are coupled to the corresponding output line 304 and input line 302 one quarter wavelength, at the center frequency of the signal of interest, away from the switching diode 308. A bias network 330 biases the shunt diode 306 and includes resistor 312 coupled between the node 324 and 326, and capacitor 316 coupled between node 324 and ground 320. A bias network 332 biases the shunt diode 310 and includes resistor 314 coupled between the node 328 and 330, and capacitor 318 coupled between node 330 and ground 320.

Figure 4:
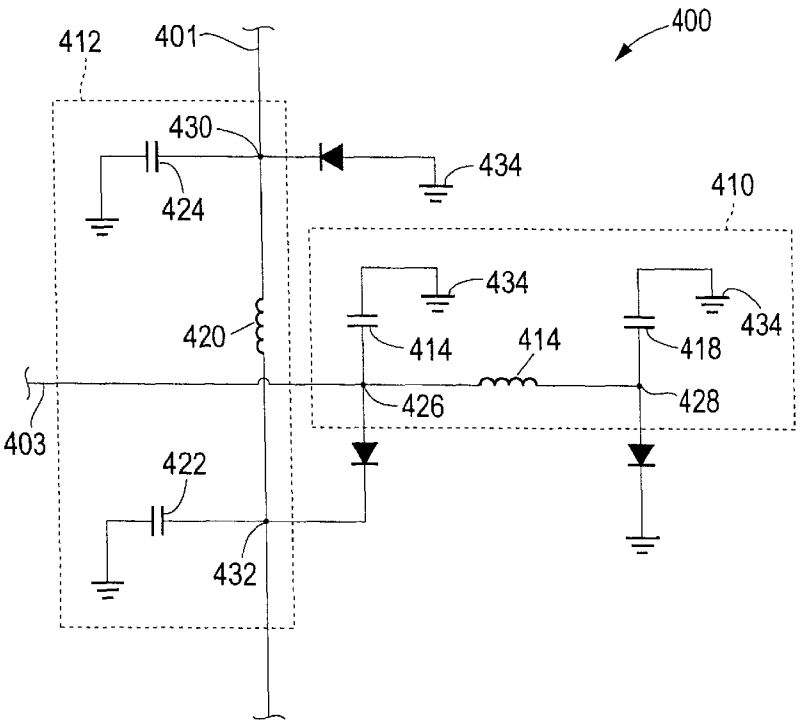
FIG. 4 is a schematic diagram of a lumped circuit equivalent to the stub tuner of FIG. 1 and FIG. 2.

In some instances, it may be advantageous to provide a lumped circuit equivalent of the electrical length a quarter wavelength shorted stub between the associated nodes. FIG. 4 depicts a switching matrix node 400 that uses lumped circuit elements to provide the functionality of a quarter wavelength shorted stub. In particular, a quarter wavelength shorted stub can be simulated by lumped circuit that includes a pi-section configured using an inductor connected in series between two capacitors that are coupled from the respective inductor to ground. In particular, the signal input line 403 includes pi-section 410. Pi section 410 includes inductor 414 coupled in series between nodes 426 and 428, capacitor 416 coupled between node 426 and ground 434, and capacitor 418 coupled between node 428 and ground 434. The values for the inductor and each of the two capacitors are given by:

$$L = \frac{Z_0}{2\pi f_0} \qquad \text{Eq. 3}$$

$$C = 1/2\pi f_0 Z_0 \qquad \text{Eq. 4}$$

where $Z_0$ is the impedance of the transmission line, $f_0$ is the frequency of interest, L is in Henrys and C is in Farads.

Thus, to a signal propagating on input line 403, there appears to be a quarter-wavelength shorted stub coupled to node 426. Similarly, the signal output line 401 includes pi-section 412. Pi-section 412 includes inductor 420 coupled in series between nodes 430 and 432, capacitor 424 coupled between node 430 and ground 434, and capacitor 422 coupled between node 432 and ground 434. Thus, to a signal propagating on output line 401, there appears to be a quarter wavelength shorted stub coupled to node 432.

Figure 5:
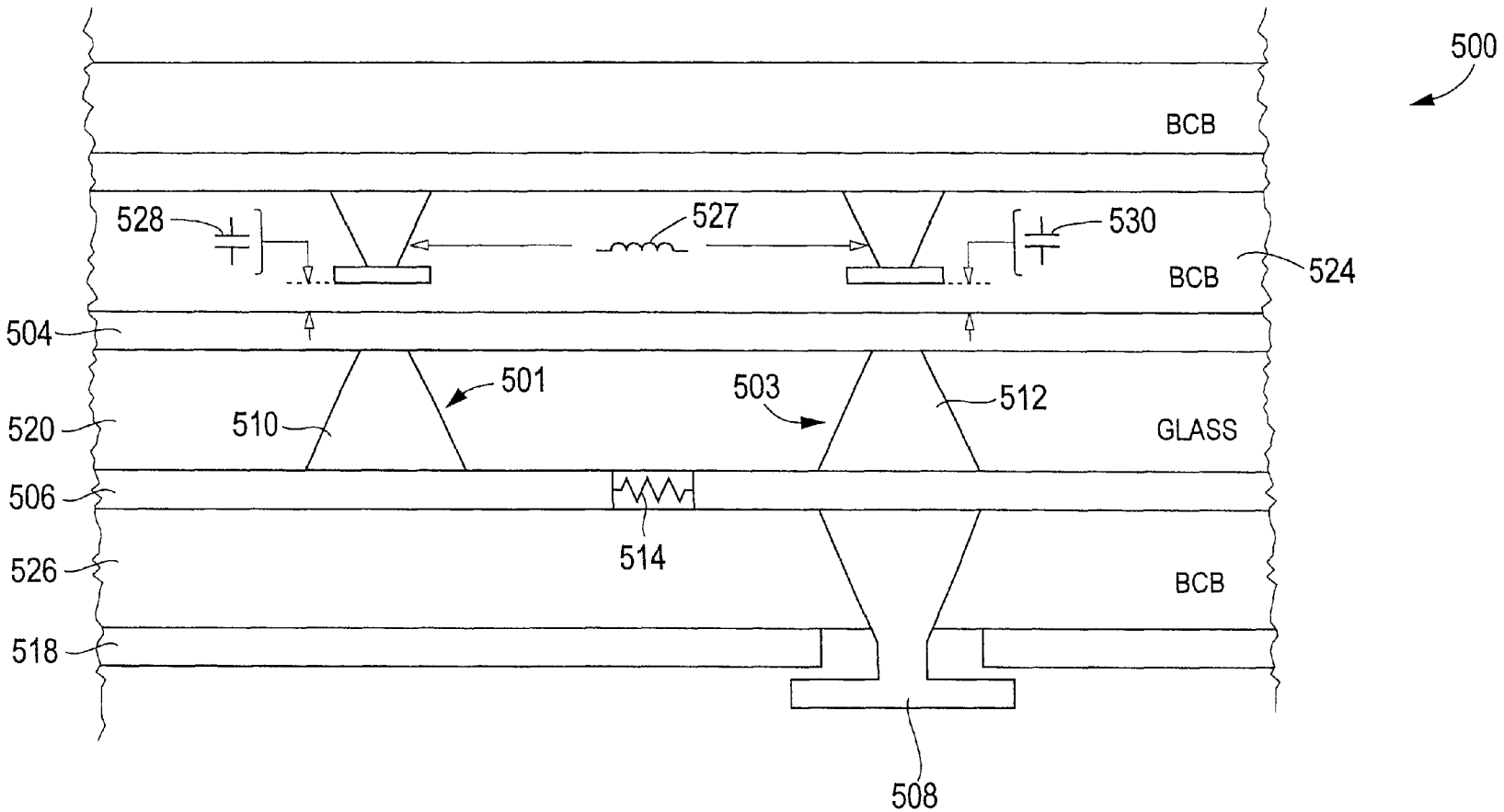
FIG. 5 is a side view of an implementation of the present invention on a substrate.

FIG. 5 depicts an embodiment for realizing the above described techniques and apparatus in a multilevel glass-based lumped circuit realization. In particular the apparatus 500 is a multi-layer circuit layout that includes a layer of substrate 520 in which a shunt diode 510 and an isolation diode 506 are disposed an equivalent of one-quarter wavelength apart at the center frequency of the signal of interest. The substrate 520 can be any suitable substrate that has a low dielectric constant, low loss tangent, and high resistivty. In a preferred embodiment, the substrate 520 is glass. In the embodiment depicted in FIG. 5, the substrate 520 is etched and processed to provide semiconductor regions 510 and 512 therewithin, and in particular, to provide PIN diodes in these regions 510 and 512. The substrate 520 includes a pair of metallized layers 504 and 506 adjacent thereto, to provide for the necessary signal conduction paths. A first layer of BCB (benzocyclobutine) 524 is provided on the top surface of metal layer 504 and a second layer of BCB 526 is provided on the bottom surface of metal layer 506. BCB provides a high impedance line such that at the frequencies of interest an inductor 527 is provided between the switching diode 510 and the isolation diode 512. Vias are provided in the BCB layer 524 and metal is deposited within the vias to provide capacitors 528 and 530. The values of the inductor 527 and the two capacitors 528 and 530 are selected to provide a lumped circuit realization of a quarter wavelength shorted stub tuner between the switching diode 510 and the isolation diode 512. Metal layer 506 includes a resistor 514. The second BCB layer 526 includes a via in which metal has been deposited and the shunt structure 508 formed. The shunt structure 508, which can be a feedthrough capacitor, includes a portion extending through an aperture in a third metal layer 518 which can be connected to a voltage reference (not shown) that is usually ground.

Those of ordinary skill in the art should further appreciate that variations to and modification of the above-described methods and apparatus for the above described broadband switch matrix with active diode isolation may be made without departing from the inventive concepts disclosed herein. Accordingly, the invention should be viewed as limited solely by the scope and spirit of the appended claims.

What is claimed is:

1. A switch matrix comprising:

a plurality of input lines having a signal input end and a non-input signal end;

a plurality of output lines having a signal output end and a non-output signal end;

a signal of interest having a center frequency;

a plurality of signal switches, each of the plurality of switches coupled to one input line and to one output line, wherein when a selected signal switch is activated, the signal of interest is connected between the input line coupled to the selected signal switch and the output line coupled to the selected switch;

a plurality of first isolation switches, each corresponding to one signal switch, each of the plurality of first isolation switches coupled to the output line corresponding to the associated signal switch and further coupled to ground, each isolation switch being coupled a first predetermined electrical length from the associated signal switch, wherein when a first isolation switch is activated, the portion of the output line between the associated signal switch and the isolation switch forms a stub of the first predetermined electrical length;

a plurality of second isolation switches, each corresponding to one signal switch, each of the second plurality of isolation switches coupled to the input line corresponding to the associated signal switch and further coupled to ground, each isolation switch being coupled a second predetermined electrical length from the associated signal switch, wherein when a second isolation switch is activated, the portion of the input line between the associated signal switch and the isolation switch forms a stub of the second predetermined electrical length.

2. The apparatus of claim 1 wherein the plurality of switches are a plurality of semiconductor switching elements.

3. The apparatus of claim 2 wherein the plurality of semiconductor switching elements are selected from the group of switching diodes, thryristors, and transistors.

4. The apparatus of claim 3 wherein the plurality of switching diodes are a plurality of PIN diodes.

5. The apparatus of claim 3 wherein the plurality of transistors are a plurality of bipolar junction transistors.

6. The apparatus of claim 3 wherein the plurality of transistors are a plurality of field effect transistors.

7. The apparatus of claim 1 wherein the plurality of first isolation switches are plurality of semiconductor switching elements.

8. The apparatus of claim 1 wherein the plurality of isolation switches are selected from the group of switching diodes, thryristors, and transistors.

9. The apparatus of claim 8 wherein the plurality of isolation diodes are a plurality of PIN diodes.

10. The apparatus of claim 8 wherein the plurality of transistors are a plurality of bipolar junction transistors.

11. The apparatus of claim 8 wherein the plurality of transistors are a plurality of field effect transistors.

12. The apparatus of claim 1 wherein the first predetermined distance is an odd integer multiple of the quarter-wavelength of the signal of interest.

13. The apparatus of claim 12 wherein the first predetermined electrical distance is one-quarter wavelength of the signal of interest.

14. The apparatus of claim 1 wherein the second predetermined electrical distance is an odd integer multiple of the quarter-wavelength of the signal of interest.

15. The apparatus of claim 14 wherein the second predetermined distance is one-quarter wavelength of the signal of interest.

16. A method of isolating a switching connection in a switching matrix having a plurality of signal switching devices, a plurality of signal input lines, a plurality of signal output lines, wherein each of the plurality of signal switching devices couples one signal input line to one signal output line and wherein each of the plurality of signal switching devices divides each input line coupled thereto into a input side and non-input side and each output line coupled thereto into a output and non-output side. The method comprising the steps of:

selecting a signal input line and a signal output line;

activating a switching device to couple the selected signal input line to the selected signal output line;

forming a first stub on the non-input side of the selected signal input line, the tuning stub being coupled to ground at a first predetermined electrical length from the switching device; and forming a second stub on the non-output side of the selected signal output line, the second stub being coupled to ground at a second predetermined electrical length from the switching device.

17. The method of claim 16 wherein the switching step includes activating the corresponding signal switch to electrically connect the selected input line and the selected output line.

18. The method of claim 16 wherein the switch matrix further includes a plurality of first isolation switching devices, each isolation switching device corresponding to a signal switching device, each isolation switching device coupled to ground and further coupled to the non-input side of the signal input line associated with the corresponding signal switching device at the first predetermined distance, the step of forming the first tuning stub includes:

activating the isolation switching device corresponding to the signal switching device, wherein the isolation switching device connects the selected signal input line to ground a predetermined distance away from the corresponding signal switching device, forming a shorted tuning stub on the non-input side of the selected signal input line.

19. A switch matrix comprising:

a plurality of input lines having a signal input end and a non-input signal end;

a plurality of output lines having a signal output end and a non-output signal end;

a signal of interest having a center frequency;

a plurality of signal switches, each of the plurality of switches coupled to one input line and to one output line, wherein when a selected signal switch is activated, the signal of interest is connected between the input line coupled to the selected signal switch and the output line coupled to the selected switch;

a plurality of first isolation switches, each corresponding to one signal switch, each of the plurality of first isolation switches coupled to the output line corresponding to the associated signal switch and further coupled to ground;

a first electrical network disposed in series between the one of the plurality of first isolation switches and the corresponding one of the signal switches, wherein the first electrical network provides an impedance transformation equivalent to a shorted stub tuner of a first predetermined electrical length;

a plurality of second isolation switches, each corresponding to one signal switch, each of the second plurality of isolation switches coupled to the input line corresponding to the associated signal switch and further coupled to ground;

a second electrical network disposed in series between the one of the plurality of second isolation switches and the corresponding one of the signal switches, wherein the second electrical network provides an impedance transformation equivalent to a shorted stub tuner of a second predetermined electrical length.

20. The apparatus of claim 19 wherein the first electrical network is a pi-section network.

21. The apparatus of claim 19 wherein the second electrical network is a pi-section network.

22. An apparatus for switching a signal of interest having a center frequency, the apparatus comprising:

a first substrate having top and bottom surfaces;

a first and second diode disposed within the first substrate;

a first metal layer having a top and bottom surface disposed on the top surface of the first substrate, wherein the bottom surface of the first metal layer is adjacent to the top surface of the first substrate;

a second metal layer having a top and bottom surface disposed on the bottom surface of the first substrate, wherein the top surface of the second metal layer is adjacent to the bottom surface of the first substrate;

a second substrate having a top surface and a bottom surface, the second substrate formed adjacent to top surface of the first metal layer, wherein the bottom surface of the second substrate is adjacent to the top surface of the first metal layer;

first and second capacitors formed within the second substrate, forming a first pi-network, wherein the first pi-network provides an equivalent of a predetermined electrical length between the first and second diodes;

a coupling to a voltage reference.

23. The apparatus of claim 22 wherein the first predetermined electrical length is an odd integer number of quarter wavelengths of the center frequency of the signal of interest.

* * * * *